US006310539B1

(12) United States Patent
Rye et al.

(10) Patent No.: US 6,310,539 B1
(45) Date of Patent: Oct. 30, 2001

(54) PANIC BUTTON SECURITY ALARM SYSTEM

(75) Inventors: David Rye, New City, NY (US); George Stevenson, Hunghom (HK)

(73) Assignee: X - 10 Ltd., Kowloon (HK)

( * ) Notice: Subject to any disclaimer, the term of this patent is extended or adjusted under 35 U.S.C. 154(b) by 0 days.

(21) Appl. No.: 09/407,217

(22) Filed: Sep. 28, 1999

Related U.S. Application Data

(63) Continuation-in-part of application No. 09/199,069, filed on Nov. 24, 1998, now abandoned, which is a continuation-in-part of application No. 08/917,452, filed on Nov. 20, 1997, now abandoned.

(51) Int. Cl.[7] ..... G08B 23/00
(52) U.S. Cl. ..... 340/321; 340/539; 340/574
(58) Field of Search ..... 340/573.1, 574, 340/539, 321; 379/37, 38, 51; 446/297, 369

(56) References Cited

U.S. PATENT DOCUMENTS 3,911,425 * 10/1975 Muncheryan ..... 340/574 X
3,938,121 * 2/1976 Jamison ..... 340/539 X
4,121,160 * 10/1978 Cataldo ..... 340/321
4,157,540 * 6/1979 Oros ..... 340/539
4,553,138 * 11/1985 Nakanishi et al. ..... 340/584
4,718,876 * 1/1988 Lee ..... 446/295
4,730,184 * 3/1988 Bach ..... 340/574 X
4,862,438 * 8/1989 Fry ..... 446/81
4,888,580 * 12/1989 Distel ..... 340/573.1
4,904,988 * 2/1990 Nesbit et al. ..... 340/628
5,153,566 * 10/1992 Yun ..... 340/689
5,235,320 * 8/1993 Romano ..... 340/539
5,438,315 * 8/1995 Nix ..... 340/539
5,461,366 * 10/1995 Figuereo et al. ..... 340/574
5,713,741 * 2/1998 DeMars ..... 434/319

* cited by examiner

*Primary Examiner*—Thomas Mullen
(74) *Attorney, Agent, or Firm*—Marvin N. Gordon

(57) ABSTRACT

An alarm unit including a normally open switch is embedded in or affixed to an item that can be easily carried by an individual, such as a toy animal or other soft toy or cushion, or which can be worn by the individual, such as a watch. The item can thus be carried by the individual wherever he or she is seated in the home. When the individual senses the presence of an intruder, he or she presses against the portion of the item that includes the alarm unit, thereby to close or actuate the switch and activate an alarm.

5 Claims, 3 Drawing Sheets

PANIC BUTTON SECURITY ALARM SYSTEM

This is a continuation-in-part of application Ser. No. 09/199,069 filed on Nov. 24, 1998, which was a continuation in part of application Ser. No. 08/917,452 filed on Nov. 20, 1997, both of which have been abandoned.

BACKGROUND OF THE INVENTION

The present invention relates generally to alarm systems, and more particularly to an alarm system for use in the home.

The increased concern in recent years of many Americans regarding their safety while in their homes has led to the availability of numerous commercial systems designed to provide an alarm upon the sensing of an intruder, such as a burglar, in the vicinity of the home. In the majority of the known home alarm systems, the presence of an intruder is sensed by a heat or motion sensor. Many of the currently available home alarm systems, in addition to producing an alarm signal, also send a signal to a remote private security station from which a telephone call can be made to the local police station to advise the police of a possible burglary at the residence. The police can then send an officer to the residence to apprehend the burglar before he has had the opportunity to cause any damage to property or person.

In addition to the use of motion or heat sensors, many available alarm systems also include a panic button that is operated by hand when a person within the residence becomes aware of the presence of an intruder. The operation of the panic button typically activates an alarm system both in the residence and at the remote security station. The alarm signal produced by the operation of a panic button is preferably different than that produced by a heat or motion detector sensor so that the security personnel and police can recognize the greater urgency of the panic button signal and the need for them to respond more quickly to a potentially dangerous situation.

One drawback of conventional panic button alarm systems is the location of the panic button in a wall-mounted control unit so that an individual who feels threatened by the presence of an intruder must get up from where he or she is sitting and walk to the location in the house where the control unit is mounted. The additional time required for the individual to walk to and then activate the panic button may be critical in being able to activate an alarm signal before the intruder gains entry into the house. Moreover, if the intruder is able to observe the person in the act of walking to the location of the panic button, he may act more hastily in a manner that may well increase the danger to the person. The conventional panic button home security systems are also relatively complex to operate, particularly by young children, since they typically require the system to be periodically armed and disarmed.

SUMMARY OF THE INVENTION

It is accordingly an object of the invention to provide a panic button security system that can be more easily used even by a child to activate an alarm signal.

It is a further object of the invention to provide a panic button security system that provides an increased feeling of security and which can be moved readily to position close to the user at all times.

In accordance with the present invention, a panic button is embedded in, or affixed by suitable means to, a movable soft household item such as a toy animal or other soft toy or a pillow or cushion. The soft household item which contains the panic button can be conveniently held by the individual, such as a child, and taken with him or her wherever he or she is seated in the home so that the child is never far from the panic button. When the individual senses an intruder, he or she presses the soft item that includes the panic button, thereby to activate the panic button and energize the alarm system both in the home and in the remote security and police stations.

In an alternative embodiment of the invention, the panic button unit is housed in a wrist watch case or housing that is worn by the individual. When the individual senses the presence of an intruder, he or she presses on the transparent glass or plastic face of the watch, thereby to activate the panic button switch and activate the alarm.

Although not specifically considered to be a novel part of the present invention, the panic button is associated with an rf transmission source, which, when activated by the operation of the panic button, transmits a coded rf signal. That signal is received at a controller which, as is conventional, operates an alarm such as a siren or horn and connects the home system over a telephone line to a remote station from where a call can be made to the local police station to advise the authorities of the presence of an intruder at the home of the individual who operated the panic button.

BRIEF DESCRIPTION OF THE DRAWINGS

To the accomplishment of the above and to any further objects that may hereinafter appear, the present invention is directed to a panic button security system substantially as defined in the appended claims and as described in the following specification, as considered along with the accompanying drawings, in which:

DETAILED DESCRIPTION OF THE INVENTION

Figure 1:
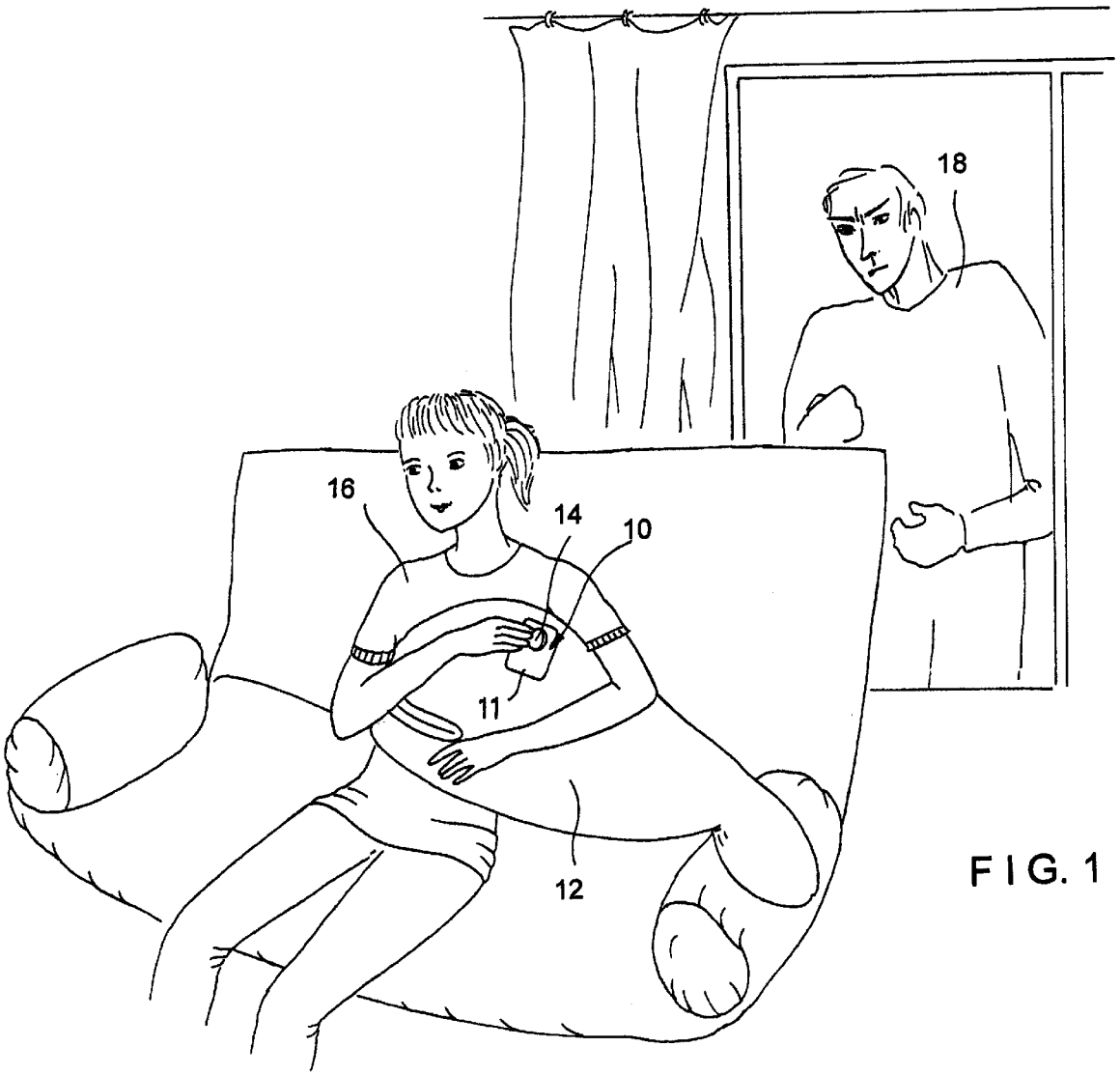
FIG. 1 is an elevation of a panic button alarm system incorporated in a soft, handheld toy in accordance with an embodiment of the invention.

FIG. 1 illustrates an embodiment of the panic button alarm system of the present invention and the manner of its use. As therein shown, a panic button unit 10 is incorporated into a soft or plush handheld toy 12, which, as shown in FIG. 1, may be a toy animal that, as shown, has the appearance of a whale. The panic button unit 10, shown in greater schematic detail in FIG. 2, may be inserted, as in the embodiment illustrated in FIG. 1, into a transparent windowed and zippered compartment 11 formed in the body of the soft toy 12. A panic button 14 included in the unit 10 is viewable through the window portion and thus accessible through compartment 11, and may, as shown, extend slightly beyond the surface of the toy 12 for engagement by the hand of a child 16. Alternatively, the panic button unit 10, including the panic button 14, may be detachably affixed, such as by the use of a Velcro fastener or the like, to the outer surface of the soft toy 12. In either case, the toy 12 is of a size and shape, which, as shown in FIG. 1, allows the child to sit on a couch or chair and read or watch television while holding the soft toy 12 snugly in her arms, preferably with one hand positioned adjacent the panic button 14.

In use, when the child 16 holding the soft toy 12 in her arms, senses the presence of an intruder 18 outside the home, she simply presses the toy 12 at the location of the window 11 (FIG. 1) or directly on the panic button 14 to, in turn, activate the panic button unit 10. This operation of the panic button 14, in the manner described below with respect to FIG. 2, activates an alarm within the home and also sends a signal to an external control station and to the police indicating that an intruder is threatening the security of the home and those within it.

The activation of the panic button 14 is carried out without the need for the child to move precipitously or to leave the couch so that the panic button can be activated quickly and, in most cases, without the knowledge of the intruder, who is thus not frightened or otherwise caused to commit a rash or hasty act that could endanger the child. The intruder's first indication that the panic button has been operated by the child is when he hears the sound of the alarm.

Figure 2:
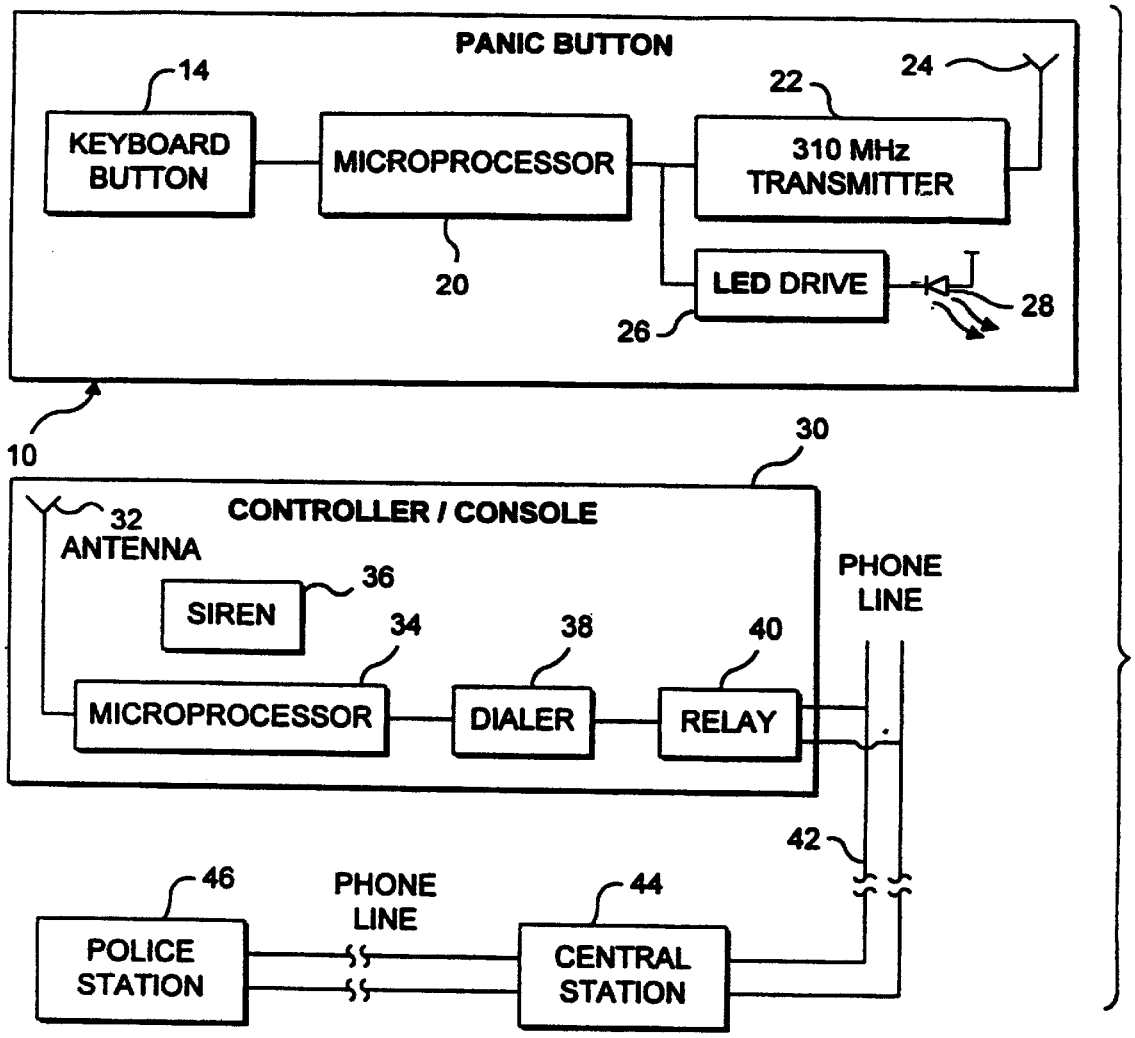
FIG. 2 is a schematic block diagram of an alarm system in which the button unit of the present invention can be used.

As shown in FIG. 2, the operation of panic button 14 closes a normally open switch to close a normally, previously open circuit and thereby apply an operating signal to a microprocessor 20. Microprocessor 20 stores a digital code that identifies the premises in which the panic alarm system is located. The microprocessor 20, when it is thus activated, applies an activating signal to the input of an rf transmitter 22, which, in response, applies a binary coded rf signal carrying the address code for the premises to an antenna 24. The activated microprocessor 20 also applies a signal to an LED driver 26 to activate an LED 28 to provide a visual indication of the activation of the panic button unit 10 by the operation of the panic button 14.

The coded rf signal transmitted from antenna 24 in unit 10 is received at a control console 30, which is located in the residence, usually at a location remote from that of the panic button unit 10. The control console 30 includes an antenna 32 that receives the rf signal from panic button unit 10, and, in turn, applies a control signal to the input of a second microprocessor 34. When that occurs, the microprocessor 34 produces a signal that activates a siren 36 in the residence as well as a dialer 38 that is connected through a relay 40 to a telephone line 42 external of the control console 30.

The dialer 38 upon its receipt of the operating signal from microprocessor 34 automatically dials a distress signal that contains an identification of the residence to an external central station 44. A telephone call can then be made from station 44 to a police station 46 to advise the police of the potentially dangerous intrusion at the residence to which the police can then promptly respond.

Figure 3:
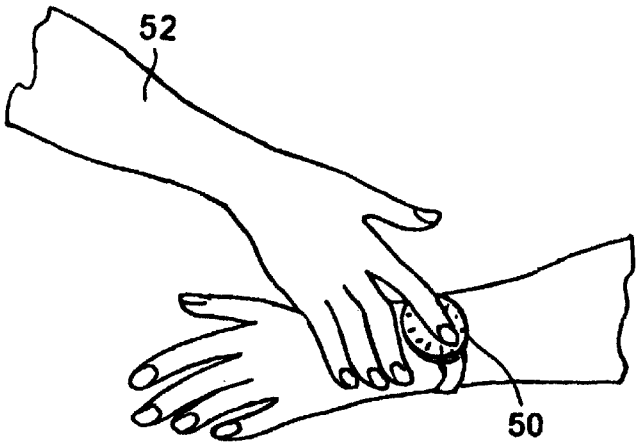
FIG. 3 is an elevation of a panic alarm system in accordance with an alternate embodiment of the invention in which the panic button unit housed inside a watch case.

FIG. 3 illustrates an alternate embodiment of the present invention in which the panic button unit is included within the case of a real or simulated wrist watch 50. When the person 52 wearing the watch on her wrist senses the presence of a prowler or an intruder, he or she presses down on the watch face to close the panic button switch contained in the interior of the watch case in FIG. 4.

Figure 4:
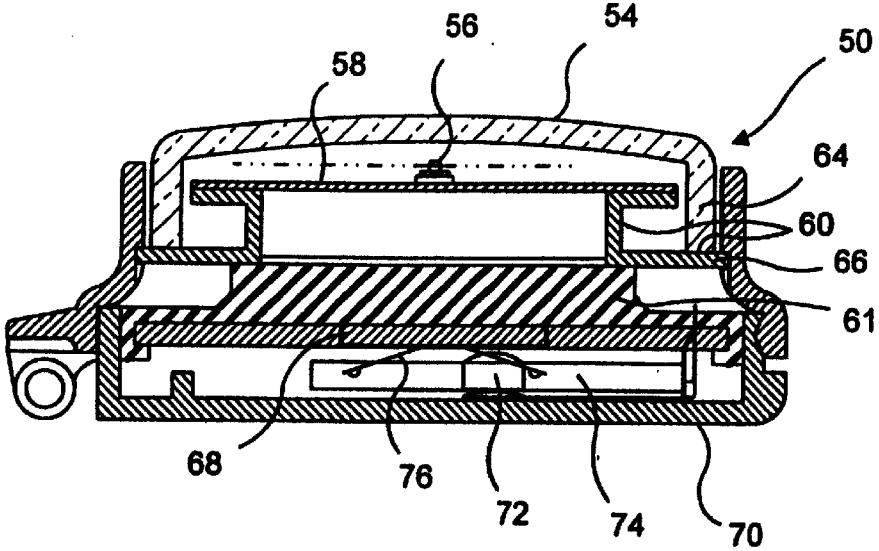
FIG. 4 is a cross-section of a watch case illustrating an alternate placement of the panic button unit in accordance with a further embodiment of the invention.

In the arrangement shown in FIG. 4, the wrist watch 50 includes a transparent case 54 having either a real or simulated dial 56 resting on a dial face 58. The latter is secured to a support flange member 60, which, in turn, rests on the peripheral outer edge of a rubber pad 61. The lower end of a peripheral wall 64 of watch case 54 rests on the outer peripheral edge 66 of support flange member 60. The lower surface of pad 61 carries one contact 68 of the panic button switch.

A back or bottom cover 70 secured to the lower end of the watch case 54 supports the other contact 72 of the panic button switch, as well as a battery 74 having one of its terminals connected to contact 72. A bow spring 76 rests against switch contact 68 and normally separates the switch contact 68 from contact 72.

In operation, when the individual senses the presence of an intruder, he or she presses down on watch case 54. That, in turn, urges support 60 and thus pad 61 against the opposing force of spring 76, until switch contact 68 is urged into electrical contact with contact 72, thereby to close or actuate the panic button switch. As in the previous embodiment, the actuation of the panic button switch operates an rf transmitter that produces a distress signal sent to a remote central location so that help can be quickly sent to the home of the individual in whose home an intruder has been detected.

It will be appreciated that whereas the present invention has been hereinabove described with respect to a single presently preferred embodiment, other embodiments of the invention may also be utilized, such as the inclusion of the panic button in a pillow, cushion or other similar commonly used soft household object. It will thus be understood that these and other variations to the described embodiment may be made without departing from the spirit and scope of the invention.

What is claimed is:

1. An alarm system including a hand-held portable item capable of being held by an individual and including a compartment having a transparent window portion, a panic button unit contained within said compartment and including push button means viewable through said window portion and accessible to the individual so as to permit manual engagement thereof by the individual, said panic button unit also including a normally open switch, said normally open switch being closed upon the manual operation of said push button means by the individual, and a signal transmitter, said switch when so closed upon the operation of said push button means being capable of activating said signal transmitter.

2. The portable alarm system of claim 1, in which said portable item is a plush toy.

3. An alarm system comprising a hand-held portable item capable of being held by an individual, a panic button unit detachably secured to the exterior surface of said portable item, said panic button unit including push button means permitting direct manual engagement thereof by the individual, said panic button unit also including a normally open switch closed upon the manual operation of said push button means by the individual, and a signal transmitter, said switch when so closed being capable of activating said signal transmitter.

4. The portable alarm system of claim 3, in which said portable item is a plush toy.

5. The combination of claim 3, in which said portable item is a watch case having a face and being capable of being carried on the individual's wrist, said push button means being closed upon the exertion of a manual force by the individual on said case.

* * * * *